US005137061A

United States Patent [19]

Deininger et al.

[11] Patent Number: 5,137,061

[45] Date of Patent: Aug. 11, 1992

[54] FLUID-DELIVERING SYSTEM

[75] Inventors: Anton Deininger, Bachhagel; Thomas Guffler, Zoeschlingsweiler, both of Fed. Rep. of Germany

[73] Assignee: The Coca-Cola Company, Atlanta, Ga.

[21] Appl. No.: 943,505

[22] Filed: Dec. 19, 1986

[30] Foreign Application Priority Data

Dec. 19, 1985 [DE] Fed. Rep. of Germany ..... 3545121

[51] Int. Cl.[5] ..... F17D 1/14

[52] U.S. Cl. ..... 141/18; 141/83; 141/98; 417/307; 417/435

[58] Field of Search ..... 261/20, 24, 26, DIG. 7; 417/309, 435, 307; 141/1-12, 18-29, 37-66, 98, 37, 83

[56] References Cited

U.S. PATENT DOCUMENTS

| | | | |
|---|---|---|---|
| 2,049,233 | 7/1936 | Thomas | 137/566 |
| 2,469,362 | 5/1949 | Bashark | 417/435 |
| 2,776,630 | 1/1957 | Fagan | 417/435 |
| 2,963,219 | 12/1960 | Palmquist et al. | 417/309 |
| 3,182,596 | 5/1965 | Prijatel | 417/309 |
| 3,224,662 | 12/1965 | Oldberg | 417/309 |
| 4,708,827 | 11/1987 | McMillin | 417/395 |

*Primary Examiner*—Henry J. Recla
*Assistant Examiner*—Casey Jacyna

[57] ABSTRACT

The water supply pump for a carbonator of a post-mix beverage dispenser is provided with a differential pressure valve which, when the pump is in operation and there is a pressure difference that is below the normal delivery pressure drop between the pump intake and discharge sides, opens a vent valve located on the pump discharge side.

10 Claims, 1 Drawing Sheet

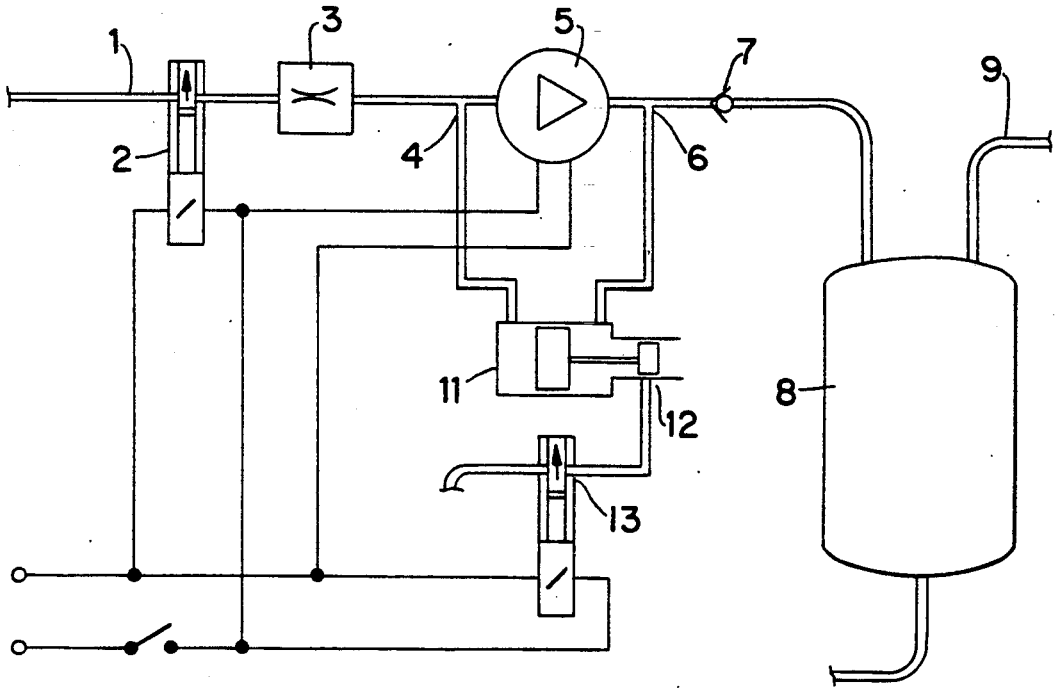
1
2
3
4
5
6
7
8
9
11
12
13

FLUID-DELIVERING SYSTEM

BACKGROUND OF THE INVENTION

The present invention relates to a fluid delivering system using a non-self priming pressure pump, in which a pressure higher than atmospheric pressure is applied to the fluid on the intake side of the pump to eliminate gas cushions in the pump chamber. These pumps being used especially for supplying fluids to a pressure tank, e.g., to a carbonator for a post-mix beverage dispenser.

To lower investment costs and to achieve good efficiency when delivering fluids, pressure pumps of known construction are usually designed such that they satisfactorily meet requirements for operating only under normal operating conditions. The usual prerequisite for normal operating conditions is that fluid be present in the pressure-pump chamber. If, no fluid is available in the pressure pump chamber for delivery, a dry cycle will occur endangering the pumping systems to a high degree. Self priming, pumping systems are capable of correcting this condition if fluid is available on the intake side, but they are expensive to make and, also, their mode of operation is not particularly advantageous.

Therefore, for many fields of application, non-self-priming pressure pumps are the most expedient means for delivering fluids. However, care must be taken that this type pressure pump be continuously filled with fluid, particularly in the starting phase. Pressure pumps of this type are, for example, used for delivering water to a carbonator of a post-mix beverage dispenser in which refreshing drinks can be prepared from water enriched with $CO_2$ and beverage concentrates. Fresh water supplied to such a carbonator is enriched with pressurized $CO_2$ gas which is likewise supplied. If required, additional fresh water must be delivered to the carbonator against this pressure. As a rule, commercial water supply with the necessary delivery pressure is not available. For this reason, a pressure pump must be incorporated into the water supply line to advance water to the carbonator. Normally, replenishment of a carbonator with fresh water occurs discontinuously, i.e., only if there is a new demand for water due to the removal of carbonated water from the carbonator. It may come to pass that, due to unfavorable circumstances, a gas cushion develops in the chamber of the pump system. Pressure built up in the carbonator counteracts any fluid flow from the pressure pump, so that the gas cushion impeding the development of the pumping action cannot be removed by the pumping action. In order that the pressure pump can again operate properly and not be exposed to adverse effects due to dry cycles, it is necessary to vent the pump chambers, for example, manually.

A suitable signalling system and the presence of an attendant to detect the condition and to vent any gas cushions are necessary for this purpose. Depending on the design of the pump, a temperature switch or a temperature fuse can, in the event of overheating of the pump system, either turn the pump off during periods of overheating—which would lead to repeated dry cycles—or switch off the pump system permanently until an attendant becomes available again to repair the damage.

SUMMARY OF THE INVENTION

The present invention for its object provides a pressure-pump system for delivering fluids which offers a high degree of safety against dry cycles of the pressure pump. A prerequisite therefor is that fluid, in fact, be present at all times in the supply conduit to the pressure pump.

According to the invention, a fluid-delivering system using, in particular, a pressure pump with non-self-priming capacity is connected in parallel with a differential-pressure system to which pressure is applied to the pump intake on one side and to the pump discharge on the other side. In operation, the differential-pressure system opens vent valve for the pressure-pump room when the differential pressure is lower than the normal delivery pressure drop across the pressure pump, and closes the vent valve by the working-pressure difference generated by the pressure pump when the pressure drops across the pressure pump is normal.

A system constructed according to these novel features makes use of the condition that, if a gas cushion exists in the pressure-pump system, the latter is incapable not only of delivering fluids, but also of generating a pressure drop. Thus, if during operation of the pressure pump no—or only a moderate—pressure drop is detected, then gas has accumulated in the pump room and has developed into a gas cushion. The invention monitors this condition by comparing, via a differential-pressure system, the pressures on the pump intake and discharge sides. This differential-pressure system controls a vent valve for the pump room in such a way that the vent valve is kept open if no—or a moderate—pressure drop is discovered, and closed if the pump delivery pressure is normal. Due to the pressure of the fluid flowing up from behind the cushion, the gas cushion can escape through the opened vent valve, so that the pump room fills with fluid and the pressure pump can again fully perform its function. To prevent the development of the gas cushions while the system is not in use, care must be taken that the air vent for the pressure-pump room be closed by suitable means when the pump is not in operation, since during shut-down times there is no pressure difference between its intake and discharge sides. For example, a valve that can be controlled via electromagnetic means is suitable for this purpose.

The system as taught by the present invention can be simplified by mounting the vent valve in the differential-pressure system on the discharge side of the pump. In this way, it is unnecessary that the pressure pump itself contain a vent valve. Another advantage is that the differential-pressure system can act directly on the vent valve via a control system.

According to a preferred embodiment, the system of the invention is characterized by a backflow-preventing valve installed in the discharge conduit downstream from the pressure pump and the differential-pressure system. The connection for the differential-pressure system and the vent valve on the pump discharge side are installed between the discharge side of the pressure pump and the backflow-preventing valve, so that this region cannot be controlled by the pressure created by backflowing fluids.

According to another preferred embodiment, the system incorporating the invention is characterized by a flow restrictor installed in the supply conduit to the pressur pump. Thus, a substantially constant fluid pressure is applied to the pump intake side during operation of the pressure pump.

Furthermore, a controllable shut-off valve which permits or prevents the flow of fluid can be installed on the intake side of the pump and the part of the differential-pressure system to prevent in the fluid flow while the system is off. While the system is in operation, this valve must be opened, while during shutdown times of the pressure pump, it must be closed.

BRIEF DESCRIPTION OF THE DRAWINGS

A practical embodiment incorporating the features of the invention is described in greater detail in the following section by reference to the accompanying drawing, in which:

The sole figure is a schematic representation comprising a system for delivering fresh water to a carbonator of an post-mix beverage dispenser incorporating a differential pressure system.

DETAILED DESCRIPTION OF PREFERRED EMBODIMENTS

From a storage tank or a public water-supply system, fresh water is passed through line 1 to an electromagnetically controlled flow-shutoff valve 2. If the flow-shutoff valve 2 is opened by electromagnetic energization, the fresh water can flow through the flow-shutoff valve 2 and a flow restrictor 3 to the intake side 4 of a pressure pump 5. The pressure pump 5 advances water from its discharge side 6 through a backflow-preventing valve 7 to a carbonator 8 in which the fresh water is enriched with $CO_2$ gas supplied under pressure via a line 9. If desired, the carbonated water, which is also cooled, can be removed from the carbonator via line 10 to prepare a refreshing drink.

By means of a conventional control system monitoring the fluid level in the carbonator 8, the pressure pump 5 can be turned on or off and the flow-shutoff valve 2 opened or closed when the level of water in the carbonator decreases below a pre-set minimum level.

Particularly, during shut-down of the pressure pump 5, it is possible for gas to accumulate forming a gas cushion in the pump housing, so that the pressure pump 5 is no longer capable of delivery. To eliminate the pressure of the gas cushion ther% is installed between pressure-pump intake 4 and discharge 6 a differential-pressure system 11 having an integrated vent valve 12. If, as a result of a gas cushion in the housing of pressure pump 5, the pressure pump 5 is incapable of delivering water, no significant pressure drop will be between pressure-pump intake 4 and discharge 6. In this condition, the differential-pressure system 11 opens the integrated vent valve 12, which is oriented towards the pump discharge side, so that a pressure approaching ambient atmosphere is produced on the pump discharge side. Water flowing in through supply line 1 can now follow up from behind into the housing of the pressure pump 5 and force the gas cushion therein through the vent valve 12. The pressure pump 5, thusly refilled, with water, delivers water while building up a pressure drop between the pressure-pump intake 4 and the pressure-pump discharge 5. Once the pressure drops across the pump reaches normal levels, the differential pressure system 11 in turn closes the integrated vent valve 12.

By means of an electromagnetically controlled passage-shutoff valve 13, which is triggered by electromagnetic means, together with the motor circuit for pressure pump 5, it is possible during shut-down of the pressure pump 5—in which, of course, no differential pressure is generated between intake 4 and discharge 6—to prevent the differential-pressure system 11 and the vent valve 12 from functioning.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The terminology in the appended claims can be correlated to elements of the drawing as follows:

| | |
|---|---|
| pressure sensor means | elements 4, 6, & 11 |
| vent valve means | elements 11 & 12 |
| backflow preventing means | element 7 |
| means for precluding | element 11. |

We claim:

1. A system for delivering fluids by means of a pressure pump in which a pressure higher than atmospheric pressure is applied to fluid at the intake side of said pump comprising:

pressure sensor means, connected in parallel to said pump in fluid communication with the intake and output side of the pump, for generating a vent signal when the difference in fluid pressure between said intake and output sides falls below a predetermined level; and vent valve means which opens for venting said pump to the atmosphere in response to said vent valve signal.

2. The system of claim 1 wherein said vent valve is disposed in fluid communication with the pump output side.

3. The system of claim 2 wherein there is further provided means for precluding said vent valve from opening when operating power is not supplied to said pump.

4. The system of claim 1 further including backflow-preventing valve means in a discharge conduit connected to said output side of said pump.

5. The system of claim 1 further including a supply conduit connected to said intake side of said pump and flow restrictor means is disposed therein for maintaining fluid pressure at said intake side substantially constant.

6. A system for delivering fluids by means of a non-self priming pump in which a pressure higher than atmospheric pressure is applied to fluid at the intake side of said pump comprising:

pressure sensor means, connected in parallel to said pump in fluid communication with the intake and output side of the pump, for detecting the presence of gas cushions in said pump and for generating a vent signal when the difference in fluid pressure between said intake and output sides falls below a predetermined level indicating the presence of a gas cushion; and vent valve means which opens for venting said pump to the atmosphere in response to said vent valve signal thereby removing any gas cushion from said pump.

7. The system of claim 6 wherein said vent valve is disposed in fluid communication with the pump output side.

8. The system of claim 7 wherein there is further provided means for precluding said vent valve from opening when operating power is not supplied to said pump.

9. The system of claim 6 further including backflow-preventing valve means in a discharge conduit connected to said output side of said pump.

10. The system of claim 6 further including a supply conduit connected to said intake side of said pump and flow restrictor means is disposed therein for maintaining fluid pressure at said intake side substantially constant.

* * * * *

UNITED STATES PATENT AND TRADEMARK OFFICE

CERTIFICATE OF CORRECTION

PATENT NO. : 5,137,061

DATED : August 11, 1992

INVENTOR(S) : Anton Deininger et al.

It is certified that error appears in the above-identified patent and that said Letters Patent is hereby corrected as shown below:

On the title page, item [73], "The Coca-Cola Company, Atlanta, Ga." and should read --The Coca-Cola Company, Atlanta, Ga. and Bosch-Siemens Hausgerate GMBH, West Germany--

Signed and Sealed this

Fifth Day of January, 1993

*Attest:*

DOUGLAS B. COMER

*Attesting Officer*

*Acting Commissioner of Patents and Trademarks*